US005282669A

United States Patent [19]

Barile

[11] Patent Number: 5,282,669

[45] Date of Patent: Feb. 1, 1994

[54] GANGING MECHANISM AND STACKING BAR ASSEMBLY FOR STACKING CHAIRS

[75] Inventor: Peter Barile, Naples, Fla.

[73] Assignee: Shelby Williams Industries, Inc., Morristown, Tenn.

[21] Appl. No.: 899,487

[22] Filed: Jun. 16, 1992

[51] Int. Cl.[5] ..... A47C 15/00

[52] U.S. Cl. ..... 297/248

[58] Field of Search ..... 297/248

[56] References Cited

U.S. PATENT DOCUMENTS

| | | | |
|---|---|---|---|
| 3,084,977 | 4/1963 | Chapman | 297/248 |
| 3,123,399 | 3/1964 | Wilson | 297/248 |
| 3,227,487 | 1/1966 | Blanchard, Jr. et al. | 297/248 |
| 3,291,523 | 12/1966 | Krueger | 297/248 |
| 3,314,718 | 4/1967 | Crandall | 297/248 |
| 3,351,378 | 11/1967 | Bliss | 297/248 |
| 3,620,567 | 11/1971 | Hendrickson | 297/248 |
| 3,697,130 | 10/1972 | Barecki et al. | 297/248 |
| 3,758,155 | 9/1973 | Straits | 297/248 |
| 4,400,031 | 8/1983 | DeDecker | 297/248 |

FOREIGN PATENT DOCUMENTS

| | | | |
|---|---|---|---|
| 2103476 | 2/1983 | United Kingdom | 297/248 |

*Primary Examiner*—Peter M. Cuomo
*Assistant Examiner*—Michael J. Milano
*Attorney, Agent, or Firm*—Silverman, Cass & Singer Ltd.

[57] ABSTRACT

A combination ganging and stacking bar assembly for chairs. The bar assembly comprises a pair of substantially identical bar members each adapted to be secured between a pair of front and rear legs of the chair. The bar members each have integral offset medial segments extending outwardly of the plane of the outwardly facing surfaces of the legs of the chair. The offset medial portions of a pair of said bar members having cooperating male and female connecting structure for releasable ganging together a pair of such chairs in side-by-side relationship. Each bar member having bumper pads secured thereon on opposite sides of the medial segment constructed and arranged to engage leg portions of the chair below it in a stacked formation of like chairs.

10 Claims, 2 Drawing Sheets

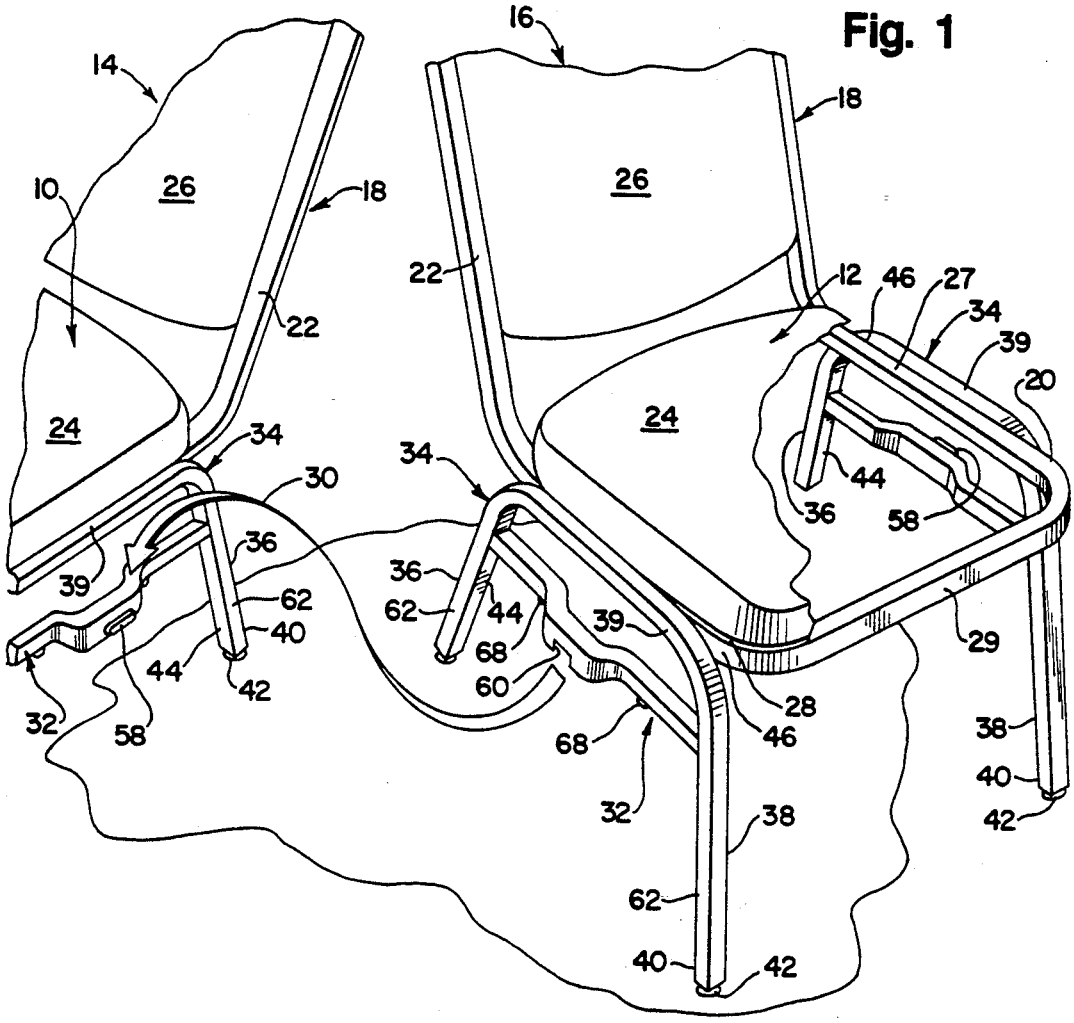
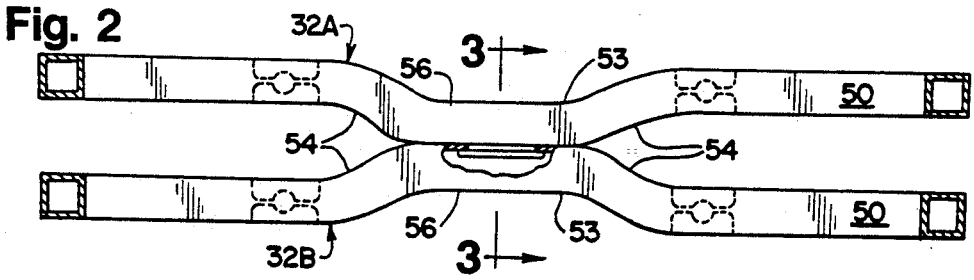
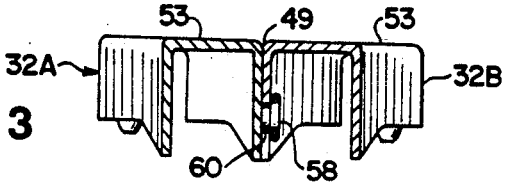
Fig. 3

Fig. 4
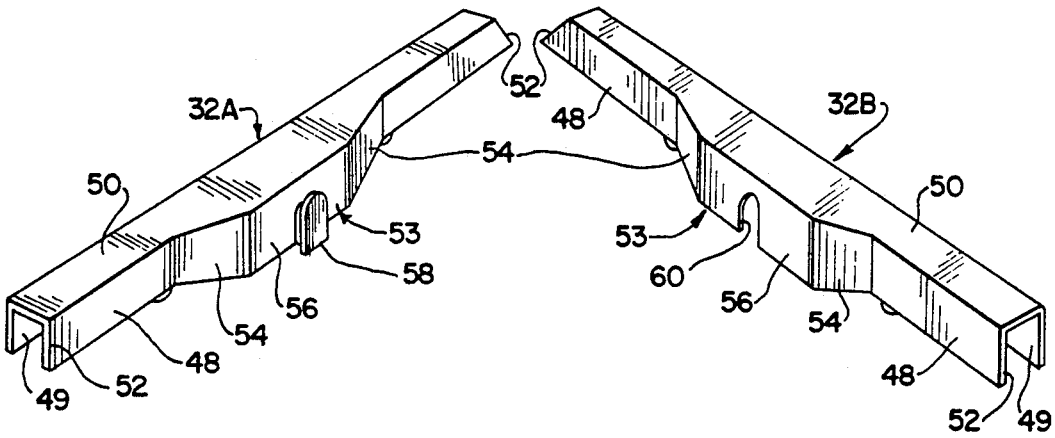
Fig. 5
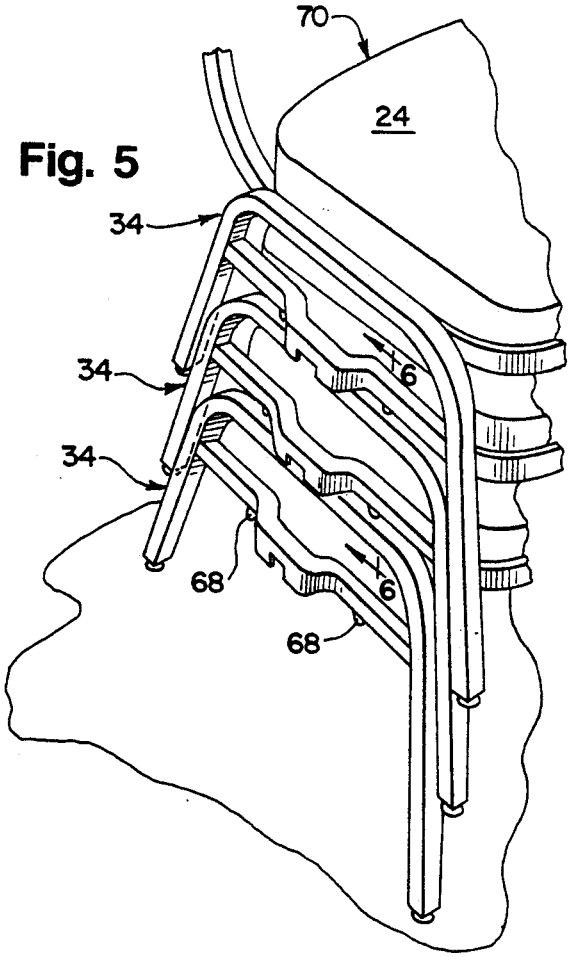
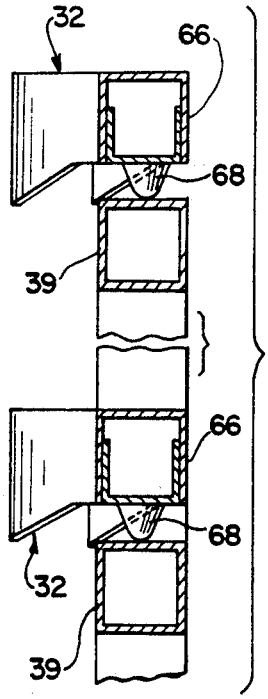
Fig. 6

GANGING MECHANISM AND STACKING BAR ASSEMBLY FOR STACKING CHAIRS

FIELD OF THE INVENTION

This invention generally relates to chairs which can be ganged together in rows and more particularly, the invention provides a novel integral combination ganging and stacking bar assembly for chairs.

BACKGROUND OF THE INVENTION

Chairs having ganging or bracket devices by means of which chairs can be releasably coupled together in rows are commonly used in classrooms, entertainment and lecture halls, synagogues and churches where temporary additional seating capacity is necessary. In such chairs, the ganging mechanism is provided along opposing side edges of the chair seat so as to enable adjoining chairs to be secured one to the other whereby to prevent inadvertent lateral separation of adjoining chairs during use thereof, especially when an occupant rises from the chair, such ganging mechanisms serve to prevent inadvertent separation of adjacent chairs so that an established row of chairs is maintained.

The ganging of chairs in rows is a matter of concern to fire prevention authorities throughout the country. In the event of fire or other panic-creating occurrence, chairs not so ganged become loose chairs as attendees bolt from the chairs. The chairs become scattered in the room and interfere with orderly exits from the room. People attempting to escape from the room can fall over such scattered chairs in their haste to escape. Ganging of chairs prevents such inadvertent scattering of loose chairs.

A problem encountered with such chairs is economic storage of the chairs in convenient access for ganging them in rows in the room or hall. A known expedient for resolving this problem is to provide such a chair capable of being stacked one upon another in close proximity to the desired floor area of intended use. In other words, the optimum chair of this type would be one which could be ganged into rows for use and stacked one upon another when not in use.

A chair capable of being both ganged and stacked is taught, in U.S. Pat. No. 3,327,984, in U.S. Pat. No. 3,610,686 in U.S. Pat. No. 3,402,963, in U.S. Pat. No. 3,328,075, in U.S. Pat. No. 4,400,031 and in U.S. Pat. No. 4,978,168.

A salient feature of this invention is to provide a chair having a combination stacking bar with an integrated ganging mechanism adapted to be secured between the front and rear legs of the chairs, said structure also being esthetically compatible with said chair legs.

Another feature of this invention is that the combination stacking and ganging capabilities are provided in a single integral stacking bar for the chair.

SUMMARY OF THE INVENTION

A ganging and stacking bar assembly for installation between each pair of front and rear legs of the chair. The bar assembly is an integral structure having the ganging or locking means along appropriate side edges thereof and bumper pads secured on the underside of the bar. Said bar has an integral offset formation into which can be formed selectively either the male engaging part or the female engaging part so that adjacent chairs can be locked together releasably in rows.

Each chair will have a bar with the male engaging part, such as a hook or tongue and a bar with the cooperating female engaging part such as a slot rigidly secured between the pair of front and rear legs thereof.

BRIEF DESCRIPTION OF THE DRAWINGS

FIG. 1 is a fragmentary perspective view of a pair of chairs juxtaposed position preparatory to being ganged or locked together by means of the ganging and stacking bar assembly embodying the invention installed on the chairs.

FIG. 2 is a transverse sectional view taken through the legs of FIG. 1 after being ganged and viewed in bottom plan with ganged bars partially broken away to show details.

FIG. 3 is a fragmentary sectional view taken along the line 3—3 of FIG. 2 and in the direction indicated generally.

FIG. 4 is a perspective view showing another pair of bar assemblies, similar to the bar assemblies of FIGS. 1 and 2, with respective male and female ganging means.

FIG. 5 is a fragmentary perspective view of a group of stacked chairs employing the invention.

FIG. 6 is a sectional view taken along the line 6—6 of FIG. 5 and in the direction indicated generally.

DESCRIPTION OF PREFERRED EMBODIMENT

Referring to FIG. 1, a pair of chair seats 10 and 12 of chairs 14 and 16, respectively, is shown in juxtaposed position preparatory to being ganged or locked together side-by-side. Each chair has a combination backrest and seat framework designated generally 18 which is formed from a continuous length of metal tubing of rectangular cross-sectional configuration. The framework 18 is bent to provide a seat support 20 and a backrest support 22. Secured to the seat support 20 is a seat cushion 24. Secured to the backrest support 22 is a backrest cushion 26.

The seat support 20 has a pair of horizontally oriented segments 27, 28 spaced one from the other and extending forwardly to the segment 29 which connects the segments 27, 28 at their forward or front ends. The seat cushion 24 is supported on the upper surfaces of the segments 27, 28 as seen in FIG. 1. The backrest cushion is secured between the span of the backrest support 22, also seen in FIG. 1.

Referring to FIG. 1, the arrow 30 illustrates the intended relative movement of the chairs 14 and 16 one toward the other to interlock the chairs in a ganged formation.

The combination ganging and stacking bar embodying the invention is designated generally by the reference character 32. The bar 32 comprises a preformed length of metal selected to fit snugly and be rigidly secured between the two legs of the leg member designated generally 34. The member 34 is comprised of an integral length of metal of rectilinear cross-sectional configuration, although a solid configuration is feasible. The member 34 is generally U-shaped to provide a rear leg 36 and front leg 38 connected by the upper horizontal segment 39 across the upper ends of the legs 36 and 38 spaced above the bottom free ends 40 of said legs.

To the free end 40 of each leg 36, 38 is attached a conventional glider member 42. As seen in FIG. 1, the front leg 38 is somewhat canted forwardly relative to the rear leg 36. The bar 32 is rigidly secured to and between the facing inner surfaces 44 of legs 36 and 38 and spaced from the connecting segment 39. A leg member 34 is rigidly secured to the outwardly facing surface 46 of each segment 27, 28 of the seat support 20, as seen in FIG. 1.

Referring to FIG. 4, the pair of bar members illustrated comprise the combination ganging and stacking bar assembly embodying the invention and designated generally by the reference character 32 in FIG. 1. For purposes of clarity of description, the bar having the male engaging means is designated 32A and the bar having the female engaging means is designated 32B. Each bar 32A and 32B is formed of channel-shaped cross-section defined by the parallel, spaced apart leg members 48, 49 connected across their upper ends by the cross-member 50. Intermediate the opposite extremities 52 of the leg member 48 is integrally formed an outwardly offset segment designated generally 53 which is defined by the two angled flat parts 54 and the linear part 56 spaced outwardly from and parallel with the plane of the leg member 48. It should be appreciated that the segment 53 can also be formed as a continuous arcuate formation with equal viability.

The bar member 32A has a male engaging lug or tongue 58 secured to and extending outwardly from the face of the linear part 56 of the offset segment 53. The bar 32B has a slot 60 which is struck from the linear wall 56 of the offset segment 53. When each of the bar members 32A and 32B is secured between a pair of legs members 36 an 38 as depicted in FIG. 1, the lug or tongue 58 will extend outwardly beyond the outwardly ±acing surfaces 62 of the leg members 36, 38. The same orientation applies for the slot 60 of bar 32B.

Further, as best seen in FIGS. 1 and 2, the linear dimension identified at 64 is across the surface 50 is substantially the same width 65 of the surface 44 of the leg member to which it is attached. This relationship 64 and 65 creates the impression that the bar 32 is an integrated part of the leg member 32 and hence, enhances the appearance of the chair. This feature of appearance enhancement created by the bar assembly 32 is an important feature of the invention.

Referring to FIGS. 2 and 3, the bar members 32A and 32B are shown with their respective male and female engagement means releasably locked together with lug 58 received in slot 60. Also seen in these FIGS. and in FIG. 6 are the bumper pads 68 which are fixed on U-shaped mounting members 66 installed between the walls 48 and 49 of the bar 32 and on opposite sides of the medial segment 53. As seen in FIGS. 5 and 6, in the stacked assembly 70 of the chairs depicted in FIG. 5, the bumper pads 68 engage upon the connecting segment 39 of the nether or adjacent lower chair of the stack. In this manner the bars 32A and 32B function also as ganging means and stacking means.

In the stacked assembly 70 of FIG. 5, it will be noted that the U-shaped leg member 34 of an upper chair fits over the leg member 34 of the chair below it in the assembly 70 so that the bumper pads 68 will rest upon the surface of connecting segment 39 of the leg support.

Minor variations in size and dimension of parts of the invention herein disclosed may occur to the skilled artisan without departing from the spirit and scope of the invention claimed.

I claim:

1. A combination ganging and stacking bar assembly adapted to be installed between each pair of aligned front and rear legs of a pair of juxtaposed chairs for releasably locking said pair of justaposed chairs against inadvertent separation, each pair of said legs having distal free ends spaced below the seat of a chair, said bar assembly comprising:

a. an integral, preformed bar member of a length selected to be secured one each between each pair of said aligned front and rear legs spaced above said free ends of said legs and spaced below the seat of the chair when so secured, said bar member having a channel-shaped cross-section including an opening therein facing a direction opposite said chair seat;

b. an offset segment formed in each bar member proximate a midpoint of the length thereof and facing a direction outwardly away from said chair legs; and c. cooperative locking means provided in a channel wall of said offset segments of each of said bar members, said locking means adapted to be matingly engaged for releasably locking said pair of juxtaposed chairs against separation.

2. The bar assembly of claim 1 including bumper pads installed in each of said channel openings of each bar member on opposite longitudinal sides of said offset segment.

3. The bar assembly of claim 1 in which said cooperating locking means comprise male and female engaging means, said male means extending outwardly away from said offset segment and said female means being provided in a wall of said channel of said offset segment.

4. The bar assembly of claim 3 in which a transverse width of the bar member is substantially similar to the leg to which it is secured so as to appear integrated therewith.

5. In combination, a chair having a unitary metal frame preformed to provide a seat support including a cushion supported on said seat support, a pair of preformed metal U-shaped leg formations each secured along opposite sides of said seat support, said leg formations including a pair of aligned leg members connected by a cross member between upper ends of the leg members, and a ganging and stacking bar assembly secured between each pair of said leg members spaced below said seat support and remote from free ends of the leg members, said ganging and stacking bar assembly comprising an integral preformed bar having a channel-shaped cross section including an opening facing oppositely from said seat support, each bar member having an offset segment positioned proximate a midpoint of the length of each of said bar members, said offset segments being provided with one of a pair of male and female engageable locking means in a wall of the channel thereof for releasably ganging a pair of chairs in justaposed position.

6. The combination of claim 5 which includes bumper pads secured in the channel of and on opposite sides of said offset segment of each bar member, said chair adapted to be stacked with other like chairs with said bumper pads engaging upon said connecting cross member of another chair.

7. The combination of claim 5 in which said locking means comprise a tongue and slot with the tongue protruding from one offset segment and the slot is formed in the other offset segment of the bar members secured between the legs of each chair.

8. The combination of claim 5 in which the width of the bar and the chair leg to which it is secured are substantially similar so as to appear integrated together.

9. A chair, comprising:

a backrest portion;

a seat portion connected to said backrest portion;

two pairs of depending leg members, one pair each connected to opposite sides of said seat portion;

first and second bar assemblies, one each extending between and secured at opposite ends to said legs of a respective pair of leg members, said first and second bar assemblies being formed with channel shaped cross-sectional configurations including longitudinal channel openings on one side thereof facing a direction opposite said seat portion, said first and second bar assemblies further being formed with offset segments proximate longitudinal midpoints thereof extending in a direction substantially perpendicular to said channel openings and outwardly away from said seat portion; and cooperative engagement means provided in said offset segments of each of said first and second bar assemblies for releasably engaging and locking said chair to another similar chair positioned adjacent thereto.

10. The chair as defined in claim 9 including a plurality of bumper pads secured in said channel openings of each of said first and second bar assemblies for providing contact with another chair when said chair is stacked thereto.

* * * * *